United States Patent [19]

Okamoto

[11] 4,319,741

[45] Mar. 16, 1982

[54] ORIGINAL PAY-OFF DEVICE FOR AN AUTOMATIC ORIGINAL FEED UNIT

[75] Inventor: Syuzi Okamoto, Hachioji, Japan

[73] Assignee: Konishiroku Photo Industry Co., Ltd., Tokyo, Japan

[21] Appl. No.: 122,713

[22] Filed: Feb. 19, 1980

[30] Foreign Application Priority Data

Feb. 20, 1979 [JP] Japan ..... 54/18769

[51] Int. Cl.[3] ..... B65H 3/06

[52] U.S. Cl. ..... 271/118; 271/127; 271/160; 271/162; 271/121

[58] Field of Search ..... 271/117, 118, 127, 162, 271/157, 160, 121

[56] References Cited

U.S. PATENT DOCUMENTS

| | | | |
|---|---|---|---|
| 3,265,384 | 8/1966 | Shute | 271/118 X |
| 3,301,551 | 1/1967 | Cassano | 271/157 X |
| 3,843,115 | 10/1974 | DiFulvio | 271/157 X |
| 4,025,066 | 5/1977 | Sue | 271/118 X |
| 4,113,244 | 9/1978 | Ruenzi | 271/127 X |

FOREIGN PATENT DOCUMENTS

| | | | |
|---|---|---|---|
| 52-37500 | 3/1977 | Japan | 271/127 |

*Primary Examiner*—Richard A. Schacher
*Attorney, Agent, or Firm*—James E. Nilles

[57] ABSTRACT

An original pay-off device comprising an original supplying tray a pay-off roller, and a drive control means for lowering the original supplying tray away from the pay-off roller when originals are loaded on the original supplying tray, and lifting the original supplying tray into contact with the pay-off roller when the originals are payed off. The supplying tray is provided such that the whole or a part of the original supplying tray can be vertically moved or oscillated with respect to a roller for use in paying off originals. The pay-off roller is positioned with its circumferential surface within the range of displacement of the original supplying tray and which is rotated always or when the originals loaded on the original supplying tray are payed off.

3 Claims, 7 Drawing Figures

FIG. 3
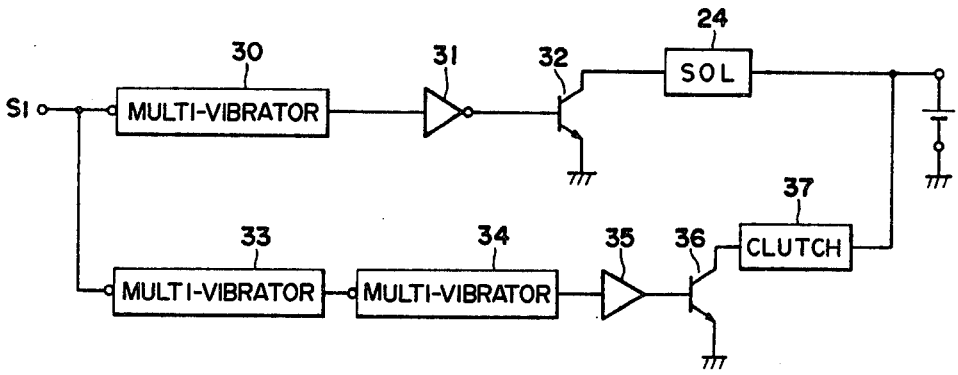
FIG. 4(a)
FIG. 4(b)
FIG. 4(c)
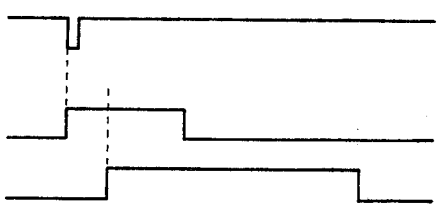
FIG. 5
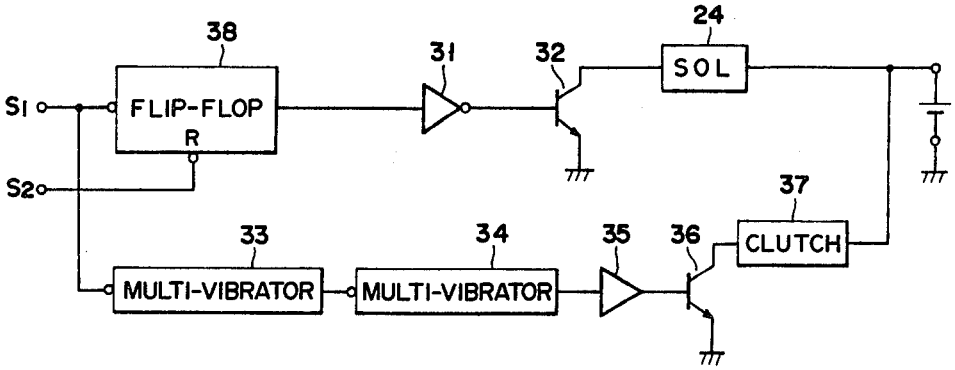

ORIGINAL PAY-OFF DEVICE FOR AN AUTOMATIC ORIGINAL FEED UNIT

BACKGROUND OF THE INVENTION

1. Field of the Invention

The present invention relates to an automatic original feed unit for copying machines and, more particularly, to an original pay-off device for use in paying off one by one the originals on an original supplying pay toward a copying position.

2. Description of the Prior Art

An automatic original feed unit is capable of automatically feeding one by one originals to be copied, which are stacked on a supplying tray or feeding table, toward a copying position through an operation of a copying button, and automatically discharging originals, which have been copied, onto a receiving tray.

FIG. 1 is a schematic illustration of an automatic original feed unit. Though this construction shows an embodiment of an automatic original feed unit be capable of applying an original pay-off device, for the convenience of description it is used as a prior art, since the construction itself does not relate to this invention, directly, and similar to that of conventional unit.

Referring to FIG. 1, a copying machine 1 is provided with an automatic original feed unit 2 which is integrally formed with a copy board thereof. This original feed unit 2 consists of a main body 3, and a movable body 5 pivotally supported on a shaft 4 in the main body 3 such that the movable body 5 can be moved in the vertical direction on the copy board. The main body 3 is provided with an original supplying tray 7 onto which one or a plurality of originals are inserted from a chute 6, a pay-off roller 8 driven by an original feeding command or instruction to pay off an original from the supplying tray 7, and a feeding roller 9 driven in the same manner at the same peripheral speed as the pay-off roller or supplying roller 8 to transfer the original towards the side of movable body 5.

The movable body 5 is provided with a transfer device consisting of a conveyor belt 11, pulleys 12, 13, idlers 14, 15, 16, a guide roller 17 and a discharge roller 18, so as to transfer an original which has been fed from the feeding roller 9 and which is placed on the copy board 10 made of glass to a proper position, and discharge the original on the copy board 10 at the completion of a copying operation therefor.

The pulley 12 (or 13) is driven by a motor (not shown) directly or via an electromagnetic clutch when an original is fed or when an original is discharged.

The movable body 5 is provided in addition to the above-mentioned members with a stopper 19 which is projected on the surface of and at the front side of the copy board 10 by a plunger action so as to stop the original to a proper position during the transfer thereof.

Reference numeral 20 denotes a guide member adapted to guide the original from the guide roller 17 to the discharge roller 18 during an original discharging operation, 21 a discharge port, and 22 a receiving tray serving also as a cover for the movable body 5.

In such a conventional automatic original feed unit, it costs much labor to introduce an original onto an original supplying tray 7 and allow the front end of the original to accurately contact a pay-off rollers. This spoils the advantages of a copying machine having an automatic original feed unit, and often prevents originals from being accurately payed off one by one. As a result, copying errors or the jamming of originals occurs frequently.

SUMMARY OF THE INVENTION

An object of the present invention is to provide an original pay-off device which permits introducing originals onto an original supplying tray easily and which permits paying off originals accurately.

BRIEF DESCRIPTION OF THE DRAWINGS

FIG. 3 is a circuit diagram of an example of drive system employed in the present invention;

FIGS. 4(*a*), 4(*b*), and 4(*c*) are time charts of actions of the drive system shown in FIG. 3; and FIG. 5 is a circuit diagram of another embodiment of drive system employed in the present invention.

DETAILED DESCRIPTION OF THE PREFERRED EMBODIMENTS

Figure 2:
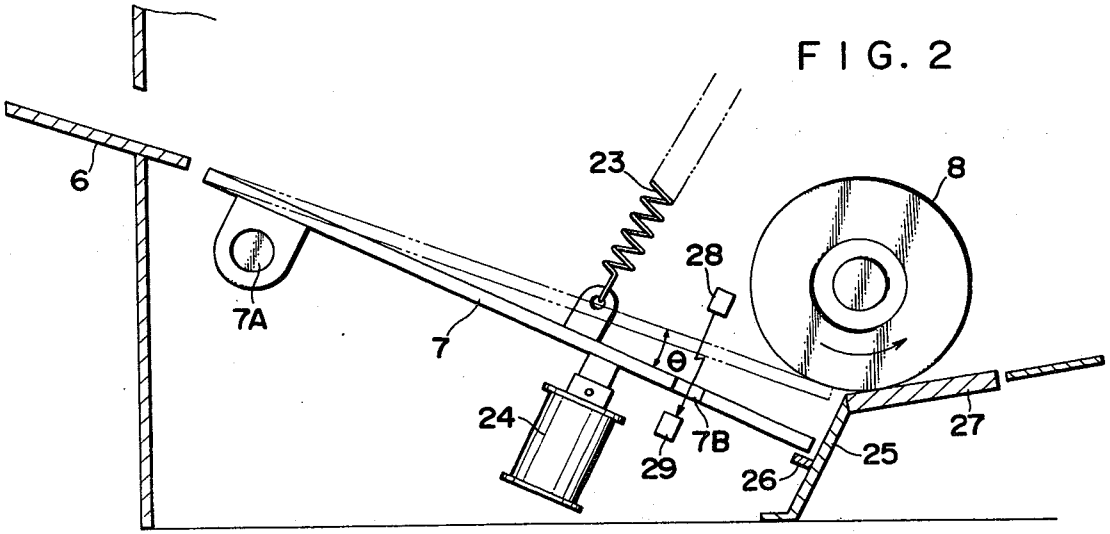
FIG. 2 shows the construction of a mechanical section of an embodiment of an original pay-off device according to the present invention.

Referring to FIG. 2, an original supplying tray 7 is supported on a pivot 7A at that end portion thereof which is on the side of an inclined original introduction chute 6. The original supplying tray 7 can be pivotally moved at an angle $\theta$ with respect to the direction in which originals are introduced into the chute 6.

The original supplying tray 7 is lifted by a tensile force of a spring 23 up to a position where the supplying tray 7 comes into contact with a pay-off roller.

The original supplying tray 7 is lowered by a tensile force of an electromagnetic plunger 24, and the lowering of the supplying tray 7 is limited by a stopper member 26 provided on an original end aligning plate 25.

When such an upwardly and downwardly movable original supplying tray 7 provided between the original introduction chute 6 and pay-off roller 8 is set in a lowered state, the front ends of originals can be aligned by the plate 25 such as to face the circumferential surface of the pay-off roller 8, by merely throwing the originals into the chute 6.

The spring 23 and electromagnetic plunger 24 for lifting and lowering the original supplying tray 7 may be used in place of each other. The original supplying tray 7 can be lifted and lowered in the same manner as mentioned above even if electromagnetic plungers are used for both of these purposes. The lifting and lowering of the original supplying tray 7 can be effected in an arbitrary manner by varying the driving mode of the plungers.

The original supplying tray 7 is provided with an opening or bore 7B therein, and a luminescent element 28 and a light-receiving element 29 are disposed above and below the opening 7B so as to detect the presence of an original on the tray 7 from variations in the quantity of light received by the light-receiving element 29.

The pay-off roller 8 driven in the direction of an arrow is provided, at that portion of its circumferential surface which is adjacent to and ahead of the front end of the supplying tray 7, with a separating member 27 elastically contacting the circumferential surface of the roller 8.

The separating member 27 consists of, for example, rubber, which has a high coefficient of friction. When two or more originals are payed off by the roller 8, only the uppermost original (contacting the roller 8) further advances since the friction between the lower original (contacting the separating member 27), which is payed off with the uppermost original contacting the roller 8, and the separating member 27 is greater than that between the uppermost original and the roller 8.

An embodiment of a drive circuit for the original supplying tray 7 and pay-off roller 8 is shown in FIG. 3.

A signal $S_1$ representative of an original pay-off instruction is a composite signal generated after an original has been copied (for example, after an original has been subjected to an exposure step or when a predetermined length of delay time has elapsed after the completion of the exposure step), and consisting of a timing signal related to a control circuit of a copying machine 1 or the actions of a mechanical section, and a pulse signal put forth only once when the loading of originals on an original supplying tray 7 is detected by a light-receiving element 29.

A mono-stable multi-vibrator 30 is started by a signal $S_1$. While the multi-vibrator 30 is in operation, a plunger 24, which has been in operation is de-energized by a turn-off action of a transistor switch 32 through a driver circuit 31. As a result, the original supplying tray 7 is lifted by a tensile force of a spring 23 to allow the uppermost original stacked on the original supplying tray 7 to come into contact with a pay-off roller 8. Thus, the uppermost original is ready to further advance.

The signal $S_1$ also causes another mono-stable multi-vibrator 33 to be started simultaneously. After the multi-vibrator 33 has stopped, a third mono-stable multi-vibrator 34 is started. A necessary delay time starting at the completion of the lifting of the original supplying tray 7 is determined by the length of operation of the mono-stable multi-vibrator 33.

While the third mono-stable multi-vibrator 34 is in operation, an electromagnetic clutch 37 is actuated by a turn-on action of a transistor switch 36 through a driver circuit 35. This electromagnetic clutch 37 connects the pay-off roller 8 to a motor, a drive source therefor.

Figure 1:
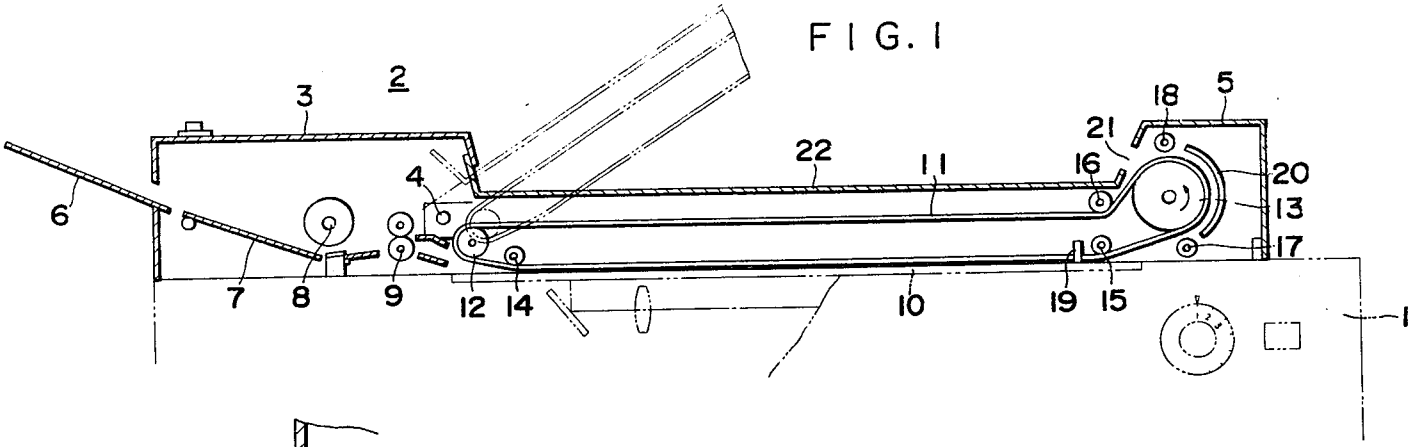
FIG. 1 is a schematic illustration of an automatic original feed unit embodying the present invention.

When the electromagnetic clutch 37 is driven by, for example, the same drive system for a conveyor belt 11 shown in FIG. 1, the electromagnetic clutch 37 has to be provided between the drive system for actuating a pulley 12, and the pay-off roller 8. When a drive system other than the one for actuating the conveyor belt 11 is employed, the electromagnetic clutch 37 is provided between the same drive system and the pay-off roller 8.

No matter which of the above two drive systems is used, the electromagnetic clutch 37 causes the pay-off roller 8 to be rotated for such a period of time that corresponds to the time during which the mono-stable multi-vibrator 34 is in operation.

For example, when a feeding roller 9 and the conveyor belt 11 are driven by other drive system than a one for the supplying roller 8, or when the supplying roller 8 and the feeding roller 9 are driven by other drive system than the one for the conveyor belt 11, the time during which the mono-stable multi-vibrator 34 is operated is set equal to time during which an original is payed off from the roller 8 and moved onto the feeding roller or the conveyor belt.

In this case, the distance between the supplying roller 8 and feeding roller 9 or a conveyor belt 11 is generally smaller than the size of a smallest standardized original in practical use. Accordingly, the following original (the original laid beneath the uppermost one) is never supplied with the upper most one. Thus, only one original which has come into contact with the supplying roller further advances to a copying position.

FIG. 4(*a*) is a diagrammatical illustration of the signal $S_1$ shown in FIG. 3; FIG. 4(*b*) a movement of the original supplying tray 7 being lifted; and FIG. 4(*c*) the action of the electromagnetic clutch 37 (supplying roller 8).

It is recommended that the starting of the supplying roller 8 be delayed with respect to the lifting of the original supplying tray 7 by a period of time equal to the one during which the mono-stable multi-vibrator 33 is operated, as shown in FIG. 4.

The original supplying tray 7 may be adapted such that the tray 7 in a lifted position is lowered before the rear end of an original, which has started being payed off, reaches the pay-off roller 8, to thereby prevent the following original from being payed off immediately.

Although the original supplying tray 7 is lifted prior to a pay-off action of the roller 8 in the above embodiment, the pay-off roller 8 may be started simultaneously with the original supplying tray 7. In such a case, a mono-stable multi-vibrator 33 as shown in FIG. 4 is not required.

The original supplying tray 7 may be lifted after the pay-off roller has been started. In such a case, a mono-stable multi-vibrator 33 as shown in FIG. 4, which is used for securing a delay time, may be provided on the side of the plunger 24.

The original supplying tray 7 in the above embodiment is lifted and lowered every time an original is payed off but it may also be designed such that it is automatically lifted when originals are loaded or when a pay-off action starting instruction is given, and lowered when all of the originals loaded have been payed off. A drive circuit employed in this case is shown in FIG. 5.

The drive circuit shown in FIG. 5 is different from that shown in FIG. 3 in that the former employs a flip-flop 38 instead of the mono-stable multi-vibrator 30 employed in the latter, which flip-flop 38 is set by a signal $S_1$ and reset by a signal $S_2$ representative of the absence of original, i.e. a signal detected by a light-receiving element 29 shown in FIG. 2.

When the flip-flop 38 in the above structure is set, the original supplying tray 7 is retained in a lifted position until all originals have been payed off.

As may be clearly understood from the above description, an automatic original feed unit according to the present invention having an original supplying tray which can be lifted and lowered permits easily loading originals as the original supplying tray is kept lowered, and accurately paying off the originals one by one by a pay-off roll and a separator as the original supplying tray is kept lifted. According to the present invention, originals can be payed off by an on-off control with respect to the lifting and lowering of an original supplying tray and the starting and stopping of a pay-off roller. This allows the control circuit for the original supplying tray and the drive circuit for the pay-off roller to be simplified.

What is claimed is:

1. An original pay-off device comprising an original supplying tray for supporting a plurality of originals, a pivot about which said supplying tray is pivotally movable and upon which said supplying tray is supported on said device, said tray being pivotable between a lifted and a lowered position, means for pivotally moving said tray and comprising a solenoid and a spring; a driven pay-off roller for frictionally engaging the uppermost of said plurality of originals upon movement of said tray into said lifted position whereby said roller moves said originals in a forward direction, said device further comprising a stationary, resilient, yieldable separating member having a relatively high coefficient of friction in abutting engagement with said roller at a point forwardly of the location of said frictional engagement between said uppermost original and said roller, said separating member frictionally engaging the lower original of a pair of originals moved in said forward direction by said roller to thereby retard the advance of said lower original.

2. The device as set forth in claim 1, wherein said solenoid is secured between said device and the lower end of said tray whereby energization of said solenoid moves said tray into said lowered position, and wherein said spring is secured between said device and the upper end of said tray whereby deenergization of said solenoid permits tensile force on said spring to move said tray into said lifted position.

3. The device as set forth in claim 2, wherein said tray has an opening therein, said device further comprising a luminescent element above said opening and a light-receiving element below said opening, said light-receiving element receiving light from said luminescent element only when no originals are supported by said tray to thereupon provide a signal to energize said solenoid.

* * * * *